US012082700B1

(12) United States Patent
Shi

(10) Patent No.: US 12,082,700 B1
(45) Date of Patent: Sep. 10, 2024

(54) FOLDABLE BED FRAME AND INFLATABLE BED

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/610,333

(22) Filed: Mar. 20, 2024

(30) Foreign Application Priority Data

Jan. 29, 2024 (CN) ..... 202420212659.2

(51) Int. Cl.

| | |
|---|---|
| ***A47C 19/14*** | (2006.01) |
| ***A47C 17/64*** | (2006.01) |
| ***A47C 17/76*** | (2006.01) |
| ***A47C 19/04*** | (2006.01) |
| ***A47C 19/12*** | (2006.01) |
| ***A47C 27/08*** | (2006.01) |

(52) U.S. Cl.
CPC ..... *A47C 19/14* (2013.01); *A47C 17/64* (2013.01); *A47C 19/04* (2013.01); *A47C 27/082* (2013.01); *A47C 17/76* (2013.01); *A47C 19/045* (2013.01); *A47C 19/12* (2013.01)

(58) Field of Classification Search
CPC ..... A47C 19/14; A47C 19/04; A47C 19/045; A47C 19/12; A47C 19/126; A47C 17/64; A47C 17/645; A47C 17/72; A47C 17/76; A47C 27/082
USPC ..... 5/11, 112, 114–117, 174, 175, 176.1, 5/177, 181, 182, 184
See application file for complete search history.

(56) References Cited

U.S. PATENT DOCUMENTS

| | | | | | |
|---|---|---|---|---|---|
| 7,712 | A * | 10/1850 | Whitmarsh | A47C 19/14 | 5/115 |
| 1,185,568 | A * | 5/1916 | Zeunert | A47B 3/00 | 5/115 |
| 1,886,112 | A * | 11/1932 | Luarde | A47B 91/04 | 248/188.4 |
| 4,846,204 | A * | 7/1989 | Sok Kyu | E04H 15/50 | 52/109 |
| 5,645,259 | A * | 7/1997 | Chen | A47B 3/12 | 108/118 |
| 6,446,282 | B1 * | 9/2002 | Wu | A47C 17/645 | 5/115 |
| 6,457,192 | B2 * | 10/2002 | Choi | A47C 19/126 | 5/112 |
| 6,564,402 | B1 * | 5/2003 | Lin | A47C 17/645 | 5/115 |
| 6,711,761 | B2 * | 3/2004 | Choi | A47C 27/081 | 5/115 |

(Continued)

*Primary Examiner* — Robert G Santos
(74) *Attorney, Agent, or Firm* — Cooper Legal Group, LLC

(57) ABSTRACT

A foldable bed frame includes a plurality of support assemblies and a plurality of foldable assemblies, the support assembly includes a support pillar and a slidable component, the slidable component is slidably connected to the support pillar, the foldable assembly includes two connection rods intersecting with each other, the two connection rods of a same foldable assembly are located between two adjacent support pillars. An inflatable bed includes a bed body, an inflatable pump, a connection assembly and the foldable bed frame, the inflatable pump is mounted in the interior of the bed body.

14 Claims, 6 Drawing Sheets

(56) References Cited

U.S. PATENT DOCUMENTS 6,792,880 B2 * 9/2004 Tsai ..... A47B 3/00 108/115
6,925,664 B1 * 8/2005 Twigg ..... A01K 1/034 5/112
7,100,221 B1 * 9/2006 Twigg ..... A01K 1/034 5/112
7,114,205 B2 * 10/2006 Choi ..... A47C 19/14 5/115
7,503,266 B2 * 3/2009 Carter ..... A47B 87/002 108/115
7,757,314 B2 * 7/2010 Yul ..... A47C 19/14 5/174
7,789,099 B2 * 9/2010 Mallookis ..... E04H 15/50 403/174
7,971,289 B2 * 7/2011 Payne ..... A47C 19/14 5/2.1
8,096,246 B2 * 1/2012 Carter ..... A47B 3/002 108/115
8,225,808 B2 * 7/2012 Mallookis ..... E04H 15/50 403/174
8,245,332 B2 * 8/2012 Yul ..... A47C 17/16 5/174
8,256,042 B2 * 9/2012 Yul ..... A47C 19/14 5/174
8,272,337 B2 * 9/2012 Carter ..... A47B 3/002 108/115
8,393,279 B2 * 3/2013 Carter ..... A47B 3/12 108/115
8,573,240 B2 * 11/2013 Mallookis ..... E04H 15/50 403/174
8,671,852 B2 * 3/2014 Carter ..... A47B 87/02 108/115
8,857,350 B2 * 10/2014 Carter ..... A47B 3/12 108/115
8,959,677 B2 * 2/2015 Yul ..... A47C 17/64 5/183
9,010,010 B2 * 4/2015 Dreiband ..... F41A 35/00 42/98
9,044,084 B2 * 6/2015 Carter ..... A47B 87/002
2001/0054198 A1 * 12/2001 Choi ..... A47C 27/082 5/114
2003/0019033 A1 * 1/2003 Choi ..... A47C 17/74 5/174
2004/0000009 A1 * 1/2004 Choi ..... A47C 27/082 5/174
2004/0065237 A1 * 4/2004 Tsai ..... A47B 3/00 108/115
2004/0104189 A1 * 6/2004 Yu ..... A47C 17/76 211/195
2007/0277709 A1 * 12/2007 Carter ..... A47B 3/12 108/115
2008/0196162 A1 * 8/2008 Yul ..... A47C 19/126 5/97
2008/0216230 A1 * 9/2008 Yul ..... A47C 17/64 297/16.2
2008/0295246 A1 * 12/2008 Yul ..... A47C 17/16 5/12.2
2009/0064415 A1 * 3/2009 Payne ..... A47C 21/08 5/658
2009/0158971 A1 * 6/2009 Carter ..... A47B 3/12 108/115
2009/0188540 A1 * 7/2009 Mallookis ..... E04H 15/50 135/121
2009/0249546 A1 * 10/2009 Yul ..... A47C 19/126 5/115
2010/0317498 A1 * 12/2010 Mallookis ..... E04H 15/50 135/144
2012/0097079 A1 * 4/2012 Carter ..... A47B 47/0083 108/106
2012/0285500 A1 * 11/2012 Mallookis ..... E04H 15/50 135/144
2013/0008356 A1 * 1/2013 Carter ..... A47B 3/002 108/166
2013/0160681 A1 * 6/2013 Carter ..... A47B 47/0083 108/106
2013/0305583 A1 * 11/2013 Dreiband ..... F41C 27/00 42/90
2014/0151318 A1 * 6/2014 Carter ..... A47B 9/20 108/116
2014/0374551 A1 * 12/2014 Carter ..... A47B 7/02 248/188.5

* cited by examiner

FOLDABLE BED FRAME AND INFLATABLE BED

CROSS-REFERENCE TO RELATED APPLICATION

The present application is based on and claims the priority benefits of China application No. 202420212659.2, filed on Jan. 29, 2024. The entirety of China application No. 202420212659.2 is hereby incorporated by reference herein and made a part of this specification.

TECHNICAL FIELD

The present application relates to the technical field of portable bed, and in particular, relates to a foldable bed frame and an inflatable bed.

BACKGROUND ART

With the growing demand for portable ways for sleep and rest of people, the traditional beds are difficult to meet people's requirements for lightweight, portability and comfort in outdoor activities, travels, office lunch breaks and other occasions.

In the existing technology, a portable inflatable bed includes an inflatable mattress, a bed frame, and a plurality of connectors. The inflatable mattress is mounted on the bed frame and is fixedly connected to the bed frame by the plurality of connectors. An airbag is mounted in the inner cavity of the inflatable mattress. The bed frame includes a plurality of vertical support rods, a plurality of horizontal connection rods and fasteners. Mounting holes configured for accommodating the horizontal connection rods are formed on each of the vertical support rods, the fasteners are usually screws or buckles, and the vertical support rods are fixedly connected to the horizontal connection rods by the screws or buckles. When mounting the inflatable bed, the plurality of horizontal connection rods are inserted into the mounting holes of the vertical support rods by users, and the plurality of horizontal connection rods and the plurality of vertical support rods are mounted sequentially and fixed by the screws or the buckles, to complete the installation of the bed frame. The inflatable mattress is then inflated. When the inflatable mattress is in the expansion state suitable for sleeping, it is mounted on the bed frame by the connectors.

In term of the above existing technology, during the installation process of the bed frame, the horizontal connection rods are engaged with the vertical support rods, and they are connected horizontally and vertically by turn and then fixed with each other by screws or buckles, by which the assembly and disassembly of the bed frame are time-consuming and labor-intensive, which affects the disassembly and assembly efficiency of bed frame.

SUMMARY

In order to improve the disassembly and assembly efficiency of the foldable bed frame, the present application provides a foldable bed frame and an inflatable bed.

In a first aspect, the present application provides a foldable bed frame, which adopts the following technical solution.

The foldable bed frame includes a plurality of support assemblies and a plurality of foldable assemblies, the plurality of support assemblies are distributed in an array, and each of the plurality of foldable assemblies is provided between two adjacent ones of the plurality of support assemblies, respectively, particularly, each of the plurality of support assemblies includes a support pillar and a slidable component, a first end of the support pillar is configured as a connection end, a second end thereof is configured as a support end, and the slidable component is slidably connected to the support pillar and slides along a length direction of the support pillar towards or departing from the connection end, and each of the plurality of foldable assemblies includes two connection rods intersecting with each other, the two connection rods of a same one of the plurality of foldable assemblies are located between two adjacent ones of the plurality of support pillars, a first end of each of the two connection rods is hinged with the connection end of one of two adjacent ones of the plurality of support pillars, and a second end of each of the two connection rods is hinged with the slidable component of the other of the two adjacent ones of the plurality of support pillars.

In the above technical solution, the support pillars, which are located the outermost side in the array, are applied with force, so that the support pillars move departing from each other. The support pillars drive the corresponding connection rods to rotate during the moving process, such that the connection rods between two adjacent support pillars are rotated, and the connection rods drive the slidable component to slide along the support pillar, such that the slidable component moves towards the connection end. At the same time, the slidable component drives another connection rod, which is connected to the slidable component, to move, so a plurality of slidable components slide along different support pillars, respectively. The two adjacent support pillars move, until there is the maximum distance between them and the slidable component reaches the highest point, so the adjacent support pillars are supported by the connection rod, thereby achieving the quickly mount of the foldable bed frame. By the foldable bed frame, it is easy to quickly increase the distance between adjacent support pillars by the support assembly and the foldable assembly, at the same time, the support of adjacent support columns can be achieved, such that a quick assembly and disassembly of the foldable bed frame can be achieved, which improves the disassembly and assembly efficiency of the foldable bed frame, reduces the folding space of the foldable bed frame, thereby further facilitating the storage and transportation of the foldable bed frame by users.

In an embodiment, the foldable bed frame further includes a height adjustment assembly, in particular, the height adjustment assembly includes a bolt, an axial direction of the bolt extends parallel to the support pillar, and the bolt is in threaded connection with the support end of the support pillar directly or indirectly.

In the above technical solution, the height adjustment assembly is in threaded connection with the support end of the support pillar directly or indirectly by the bolt, which is conductive to the adjustment of the length of the bolt extending out of the support pillar, and in turn to the adjustment of the whole length of the bolt and the support pillar, thereby achieving the adjustment of the whole length of the foldable bed frame.

In an embodiment, the height adjustment assembly further includes a support base, the support base is connected to an end of the bolt departing from the support pillar, and a cross-section area of the bolt is less than that of an end surface of the support base departing from the support pillar.

In the above technical solution, the contract area of the bolt and the ground can be increased by means of the support base, which can reduce the pressure at the contract position between the ground and the bolt, thereby preventing the bolt from sinking into the ground, which ensures the stable placement of the foldable bed frame, and improves the overall stability of the foldable bed frame.

In an embodiment, the height adjustment assembly further includes a base sleeve screwed to the bolt, and an end of the base sleeve departing from the support base is fastened on the support pillar.

In the above technical solution, the base sleeve facilitates the connecting between the bolt and the support pillar, thereby adjusting the length of the bolt extending out of the support pillar.

In an embodiment, the slidable component includes a slidable sleeve and at least two hinge flaps, the slidable sleeve is slidably connected to the support pillar and slides along a length direction of the support pillar, the at least two hinge flaps are fixedly connected to a peripheral wall of the slidable sleeve, and each of the at least two hinge flaps is configured to be hinged with a respective one of the two connection rods.

In the above technical solution, the support pillars, which are distributed in matrix and located the outermost side, are applied with force, so that the support pillars move departing from each other. One end of the respective connection rod is driven to rotate during the movement of the support pillar, and the other end of the connection rod applies force to the hinge flaps. The hinge flaps drive the slidable sleeve to move, such that the slidable sleeve slides along the support pillar. By means of the slidable component, the connection rod is easy to be mounted, at the same time, it is convenient for one end of the connection rod to slide along the support pillar, and in turn for the connection rod to rotate, thereby adjusting the distance between two adjacent support pillars and supporting the two adjacent support pillars.

In an embodiment, the support pillar includes a stationary section, a slidable section and at least one adjustment component, the support end is located on the stationary section, the connection end is located on the slidable section, the stationary section is located close to the bolt, the slidable section is coaxially sleeved on the stationary section, the slidable section is slidable along a length direction of the stationary section, the slidable component is slidably connected to the slidable section, and the adjustment component is configured to position the slidable section relative to the stationary section.

In the above technical solution, the slidable section is applied with force, such that it slides along the stationary section. When reaching the required position, the adjustment component is adjusted, to position the slidable section. By means of the designed telescopic support pillar, it is easy to adjust the overall length of the support pillar, thereby reducing the space occupancy rate of the foldable bed frame.

In an embodiment, the adjustment component includes a first spring and a limit rod, a first mounting groove, in which the limit rod is slidable, is defined on a sidewall of the stationary section, the first mounting groove is positioned close to the slidable section, the first spring is located in the first mounting groove, a first end of the first spring abuts against the stationary section, a second end of the first spring abuts against the limit rod, and a first opening configured to be inserted in by the limit rod is defined on an inner wall of the slidable section.

In the above technical solution, in the process that the slidable section slides away from the stationary section, an end of the limit rod departing from the first spring abuts against the side wall of the stationary section. When the slidable section slides to the position where the limit rod is directly aligned with the first opening, the first spring in the compressed state is restored. The first spring pushes the limit rod into the first opening, such that it is engaged with the sidewall of the first opening, thereby fixing the position of the slidable section. By means of the adjustment component, it is easy to fix the position of the slidable section, thereby limiting the height of the support pillar.

In an embodiment, an end of the limit rod facing the first opening is hemispherical.

In the above technical solution, the limit rod with hemispherical shape easily slides out of the first opening, which drives the foldable assembly to quickly fold, thereby improving the folding efficiency of the support pillar and further improving the folding efficiency of the foldable bed frame.

In an embodiment, the support assembly further includes a mounting block and a connection sleeve, the connection sleeve is sleeved on the connection end of the support pillar, a second mounting groove configured to be inserted in by the mounting block is defined on the outer wall of the connection sleeve, the second mounting groove extends along a radial direction of the support pillar, and a side of the mounting block departing from the support pillar is configured to be hinged with a respective one of the two connection rods.

In the above technical solution, with the designed support assembly, the external bed body and the mounting block are easy to be mounted by a connection sleeve, and the connection rod is easily connected to the support pillar by the mounting block, thereby achieving a detachable connection between the connection rod and the support column, so as to achieve the disassembly and replacement of the connection rod.

In an embodiment, the support assembly further includes two sets of mounting components, the two sets of mounting components are symmetrically arranged at opposite sides of the mounting block, each mounting component of the two sets of mounting components includes a second spring and a lock rod, a third mounting groove, in which the lock rod is slidable, is defined at a side of the mounting block facing the connection sleeve, the second spring is mounted in the third mounting groove, a first end of the second spring abuts against the mounting block, a second end of the second spring abuts against the lock rod, and an insertion hole configured to be inserted in by the lock rod is defined on the connection sleeve.

In the above technical solution, in the process that the mounting block enters into the second mounting groove, an end of the lock rod departing from the second spring abuts against the sidewall of the second mounting groove. Until the mounting block moves to the position where the lock rod is directly aligned with the insertion hole, the compressed second spring is restored, which pushes the lock rod to insert into the insertion hole, such that it is engaged with the connection sleeve. With the mounting component, the mounting block can be stably locked with the connection sleeve, thereby achieving a fixed connection between the mounting block and the connection sleeve.

In an embodiment, an end of the lock rod facing the insertion hole is hemispherical.

In the above technical solution, the lock rod with hemispherical shape easily slides out of the insertion hole, thereby achieving the quick disassembly and assembly of the mounting block and the connection sleeve.

In an embodiment, each of the plurality of foldable assemblies further includes a hinge joint, the hinge joint includes an upper hinge portion, a lower hinge portion and a fastener, the upper hinge portion is directly above the lower hinge portion, and the upper hinge portion is fixedly connected to the lower hinge portion by the fastener, and each of the two connection rods includes two connection sections, defined as a first connection section and a second connection section, in particular, the first connection section is hinged with the upper hinge portion, the second connection section is hinged with the lower hinge portion, the first connection section is hinged with the mounting block at an end departing from the upper hinge portion, and the second connection section is hinged with the slidable component at an end departing from the lower hinge portion.

In the above technical solution, the connection rod is divided into two connection sections, which are hinged with the upper hinge portion and the lower hinge portion, respectively, thereby facilitating the folding of the connection rod, and the maintenance or replacement of a single connection section of the connection rod, while reducing the space occupancy rate of the foldable bed frame, which is convenient for users to store and transport the foldable bed frame.

In an embodiment, the fastener includes a lock lever, two snap-in blocks and a third spring connected to the snap-in blocks, the lock lever is fixedly connected to a bottom wall of the upper hinge portion, and a lock hole configured to be inserted in by the lock lever is defined on the lower hinge portion, a second opening, in which a respective one of the two snap-in blocks is slidable, is defined on a hole wall of the lock hole, the second opening is in communication with the lock hole, the third spring is located in the second opening, a first end of the third spring abuts against the respective one of the two snap-in blocks, and a second end thereof abuts against a bottom wall of the second opening, and a recess configured for snapping the respective one of the two snap-in block is defined on a sidewall of the lock lever.

In the above technical solution, the connection rod expands to drive the upper hinge portion and lower hinge portion to approach each other, such that the lock lever approaches the lock hole until the lock lever is inserted in the lock hole. In the process that the lock lever enters into the lock hole, the lever wall of the lock lever abuts against the snap-in block. Until the lock lever moves to the position where the recess is directly aligned with the snap-in block, the compressed third spring is restored, which pushes the snap-in block to enter into the recess and abuts against the wall of the recess, thereby achieving a stable connection between the upper hinge portion and the lower hinge portion. The lock lever is inserted into the lock hole, to easily achieve a stable connection between the lock lever and the lower hinge portion, which improves the connection stability of the upper hinge portion and the lower hinge portion.

In a second aspect, the present application provides an inflatable bed, adopting the following technical solution.

An inflatable bed includes a bed body, an inflatable pump, a connection assembly and the foldable bed frame, particularly, the inflatable pump is configured for supplying air to an interior of the bed body, and the bed body is provided on the foldable bed frame, and the bed body is connected to the foldable bed frame by the connection assembly.

In the above technical solution, the bed body is connected to the foldable bed frame by the connection assembly, the bed body is inflated through the air tube by the inflatable pump, such that the bed body gradually expands. During the expansion of the bed body, the foldable assembly is driven to unfold until the bed body is in an expansion state suitable for sleeping. By the provided inflatable bed, the bed body expands through inflation, such that the foldable assembly is driven to unfold, to provide a stable support for the bed body, which is conducive to the using convenience of the inflatable bed and the foldable bed frame.

In an embodiment, the inflatable bed further includes a connection assembly, which includes a plurality of buckles, each of the plurality of buckles includes a buckle head and a connection portion which are integrally formed, the connection portion is fixedly connected to a bottom wall of the bed body, and a buckle hole configured for fitting with the buckle head is defined on a top wall of the connection sleeve.

In the above technical solution, by providing the connection assembly, the inflatable bed is easy to connect to the foldable bed frame by locking the buckle and the buckle hole, thereby improving the assembly and connection efficiency of the bed body and the foldable bed frame, while facilitating the disassembly and assembly or maintenance of the bed body and the foldable bed frame.

In summary, at least one of the following beneficial effects is realized.

By the foldable bed frame, it is easy to quickly increase the distance between two adjacent support pillars by the support assembly and the foldable assembly, at the same time, the support of two adjacent support columns can be achieved, such that a quick assembly and disassembly of the foldable bed frame can be achieved, which improves the disassembly and assembly efficiency of the foldable bed frame, and reduces the folding space of the foldable bed frame, thereby facilitating the storage and transportation of the foldable bed frame by users.

By the provided inflatable bed, the bed body expands through inflation, such that the foldable assembly is driven to unfold, to provide a stable support for the bed body, which is conducive to the using convenience of the inflatable bed and the foldable bed frame.

DETAILED DESCRIPTION

The present application will be further described in detail below in combination with FIGS. 1-7.

A foldable bed frame is disclosed in the embodiment of the present application.

Figure 1:
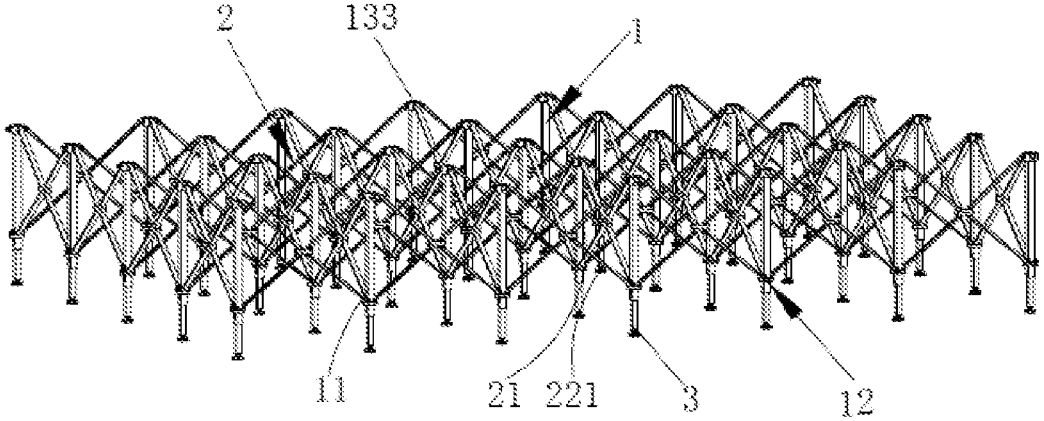
FIG. 1 is a schematic view showing the overall structure of the foldable bed frame according to the embodiment of the present application.

Referring to FIG. 1, the foldable bed frame includes a plurality of support assemblies 1, a plurality of foldable assemblies 2 and a height adjustment assembly 3. The plurality of support assemblies 1 are distributed in an array. Each of the plurality of foldable assemblies 2 is located between two adjacent support assemblies 1, and the height adjustment assembly 3 is directly under the support assembly 1.

Figure 2:
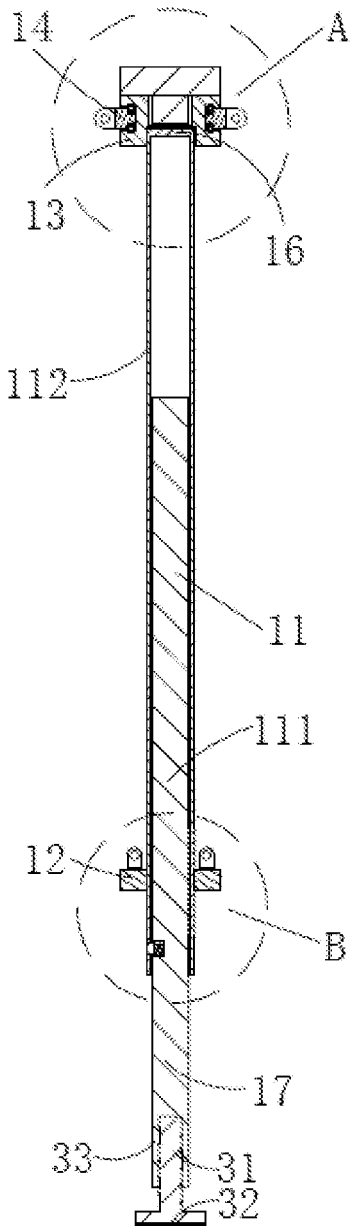
FIG. 2 is a sectional view of the foldable bed frame according to the embodiment of the present application for illustrating the support assembly.
Figure 3:
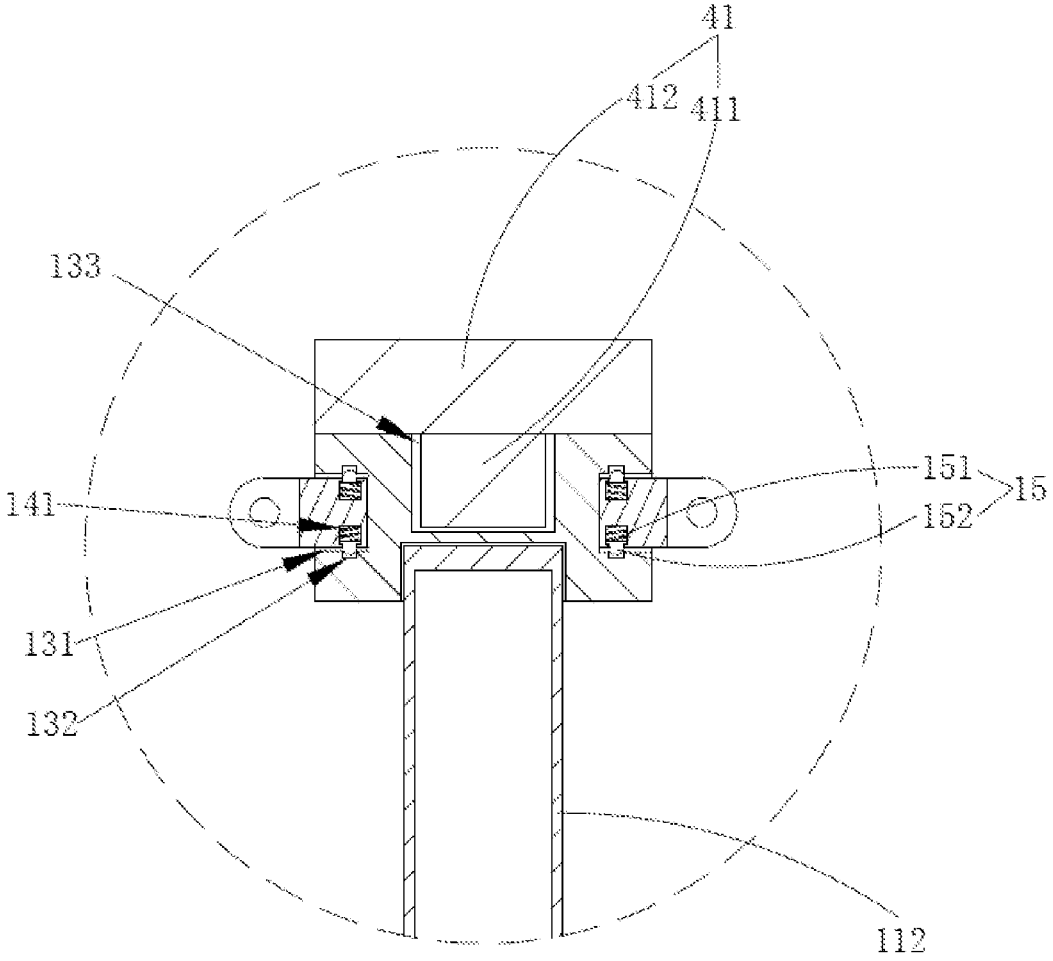
FIG. 3 is an enlarged view of portion A in FIG. 2 according to the embodiment of the present application.

Referring to FIGS. 2-3, the support assembly 1 includes a support pillar 11, a slidable component 12, a connection sleeve 13, a mounting block 14 and a mounting component 15. An end of the support pillar 11 facing the height adjustment assembly 3 is a support end 17, and the other end thereof is a connection end 16. The support pillar 11 includes a stationary section 111, a slidable section 112 and at least one set of adjustment components 113. One set or two sets or three sets of adjustment components 113 can be provided in the present application, as long as the position of the slidable section 112 can be limited. In this embodiment, one set of adjustment components 113 is provided. The stationary section 111 is located at the side of the support pillar 11 close to the height adjustment assembly 3, while the slidable section 112 is coaxially sleeved on the stationary section 111, and the slidable section 112 is slidable along the length direction of the stationary section 111. The support end 17 is located on the stationary section 111, while the connection end 16 is located on the slidable section 112.

Figure 4:
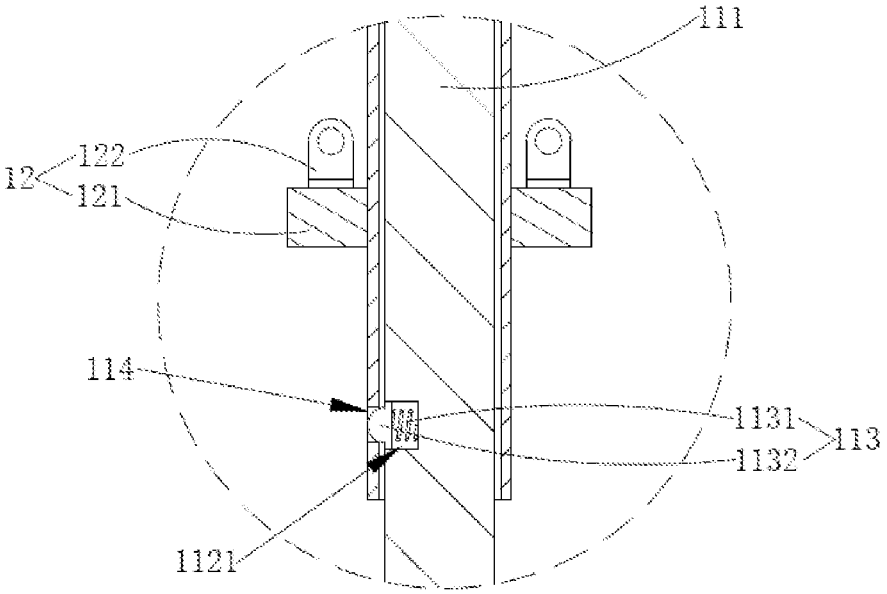
FIG. 4 is an enlarged view of portion B in FIG. 2 according to the embodiment of the present application.

Referring to FIGS. 2 and 4, the adjustment component 113 includes a first spring 1131 and a limit rod 1132. A first mounting groove 1121 is formed on the sidewall of stationary section 111, in which the limit rod 1132 is slidable. The first mounting groove 1121 extends horizontally. The first spring 1131 is located in the first mounting groove 1121, an end of the first spring 1131 abuts against the bottom wall of the first mounting groove 1121, while the other end thereof abuts against the limit rod 1132. A first opening 114 configured to be inserted in by the limit rod 1132 is formed on the inner wall of the slidable section 112. An end of the limit rod 1132 facing the first opening 114 is hemispherical, and the first opening 114 is configured as a hemispherical opening for fitting with the hemispherical end of the limit rod 1132.

Referring to FIGS. 2-3, the connection sleeve 13 is sleeved on the connection end 16 of the support pillar 11. A second mounting groove 131, which extends along the radial direction of the support pillar 11, configured to be inserted by the mounting block 14 is formed on the connection sleeve 13. The mounting block 14 is located in the second mounting groove 131 and abuts against the groove wall of the second mounting groove 131. The mounting component 15 is located in the mounting block 14, and two sets of the mounting components 15 are arranged symmetrically at the opposite sides of the mounting block 14. The mounting component 15 includes a second spring 151 and a lock rod 152, and the third mounting grooves 141 are formed on the opposite sidewalls of the mounting block 14 facing the connection sleeve 13. The third mounting grooves 141 extend along the length of the support pillar 11. The second spring 151 is mounted in the third mounting groove 141, and one end of the second spring 151 abuts against the bottom wall of the third mounting groove 141, while the other end thereof abuts against the lock rod 152. In the present application, an end of the lock rod 152 departing from the second spring 151 is hemispherical, the insertion holes 132 configured to be respectively inserted by the lock rods 152 are respectively formed on the opposite sides of the third mounting groove 141, in particular, the insertion hole is designed as a hemispherical hole for fitting with the hemispherical end of the lock rod 152.

Referring to FIG. 4, the slidable component 12 is slidably connected to the slidable section 112, and the slidable component 12 can move departing from or towards the connection end 16 along the length direction of stationary section 111. The slidable component 12 includes a slidable sleeve 121 and at least two hinge flaps 122. In the present application, two, three, or four hinge flaps 122 can be provided, as long as a connection rod 21 can be hinged with the slidable sleeve 121. In order to ensure the hinge effect, each slidable sleeve 121 is provided with four hinge flaps 122 evenly distributed in the circumferential direction of the support pillar 11 in this embodiment.

Referring to FIG. 2, the height adjustment assembly includes a bolt 31, a support base 32 and a base sleeve 33, and the bolt 31 extends parallel to the support pillar 11 in the axial direction. An end of the bolt 31 is in threaded connection with the support end 17 of the support pillar 11, and the other end thereof is in threaded connection with the support base 32. The support base 32 is located at an end of bolt 31 departing from the support pillar 11, and the support base 32 is disc-shaped. The cross section area of the bolt 31 is less than that of an end surface of the support base 32 departing from the support pillar 11. The base sleeve 33 is in threaded connection with the bolt 31, and an end of the base sleeve 33 departing from the support pillar 11 is welded with the support end 17 of the support pillar 11.

Figure 5:
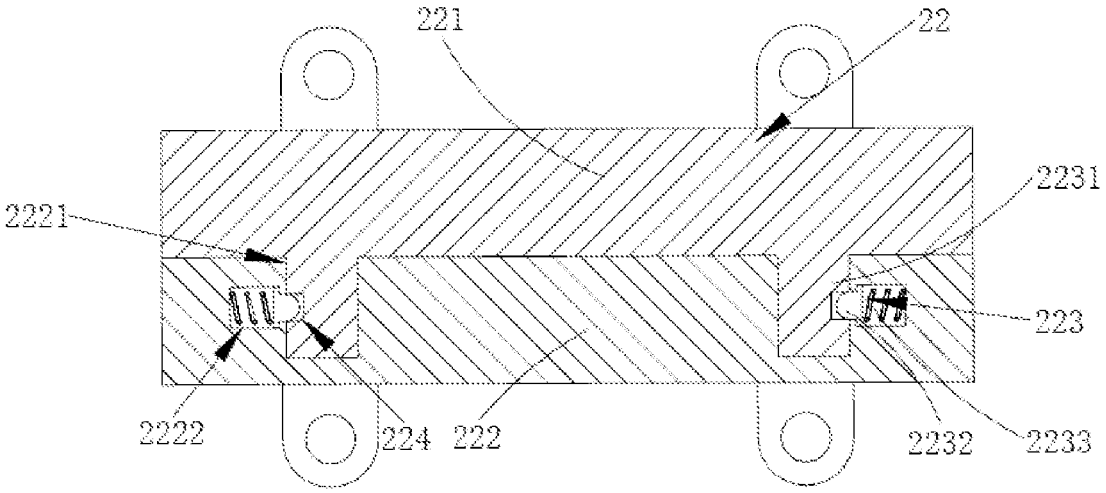
FIG. 5 is a structural view of the foldable bed frame according to the embodiment of the present application for illustrating the foldable assembly.

Referring to FIG. 5, the foldable assembly 2 includes two connection rods 21 intersecting with each other and a hinge joint 22 located at the intersection of the two connection rods 21, and the two connection rods 21 of a same one foldable assembly 2 are located between two support pillars 11. The hinge joint 22 includes an upper hinge portion 221, a lower hinge portion 222 and a fastener 223, the upper hinge portion 221 is directly above the lower hinge portion 222, and the fastener 223 is configured to fixedly connect the upper hinge portion 221 with the lower hinge portion 222. The connection rod 21 includes two connection sections 211, in which one connection section 211 is hinged with the upper hinge portion 221, and the other connection section 211 is hinged with the lower hinge portion 222. The connection section 211, which is hinged with the upper hinge portion 221, is hinged with the mounting block 14 at one end departing from the upper hinge portion 221, and the connection section 211, which is hinged with the lower hinge portion 222, is hinged with the slidable sleeve 121 at one end departing from the lower hinge portion 222 by the hinge flap 122. The fastener 223 includes a lock lever 2231, two snap-in blocks 2232 and a third spring 2233 abutting against each snap-in block 2232. One lock lever 2231, two or three lock levers can be provided in the present application. In order to reduce cost and ensure the connection stability between the upper hinge portion 221 and lower hinge portion 222, two lock levers 2231 are provided in this embodiment, in which two lock levers 2231 extend vertically and distributed symmetrically on the bottom wall of the upper hinge portion 221. Two lock holes 2221 configured to be respectively inserted in by the lock levers 2231 are correspondingly formed on the lower hinge portion 222, which are opposite to the lock levers 2231, respectively. In the present application, two or four snap-in blocks 2232 can also be provided, correspondingly, two or four recesses 224 are provided, as long as the lock lever 2231 can be stably connected to the lower hinge portion 222 through the stable insertion of the snap-in block 2232 in the recess 224. In this embodiment, two snap-in blocks 2232 and two recesses 224 are provided. A second opening 2222, in which the snap-in block 2232 is slidable, is formed on the hole wall of the lock hole 2221. The second opening 2222 extends horizontally and is in communication with the lock hole 2221. The third spring 2233 is located in the second opening 2222, and one end of the third spring 2233 abuts against the bottom wall of the second opening 2222, and the other end thereof abuts against the snap-in block 2232. The recess 224 configured for snapping the snap-in block 2232 is formed on the sidewall of the lock lever 2231, and the recess 224 is defined on the side of the lock lever 2231 facing the second opening 2222.

The implementation principle of the foldable bed frame for this embodiment of the present application is as follows. Firstly, the support pillars 11, which are distributed in matrix and located the outermost side, are applied with force, so that the support pillars 11 move departing from each other. The support pillars 11 drive the corresponding connection rods 21 to rotate during the moving process, such that the connection rods 21 between two adjacent support pillars 11 are rotated, and the connection rods 21 drive the slidable component 12 to slide along the support pillar 11, such that the slidable component 12 moves towards the connection end 16. At the same time, the slidable component 12 drives another connection rod 21 to move, so a plurality of slidable components 12 slide along different support pillars 11, respectively. The two adjacent support pillars 11 move, until there is the maximum distance between them and the slidable component 12 reaches the highest point, so the adjacent support pillars 11 are supported by the connection rod 21, thereby quickly mounting the foldable bed frame.

An inflatable bed is disclosed in the embodiments of present application.

Figure 6:
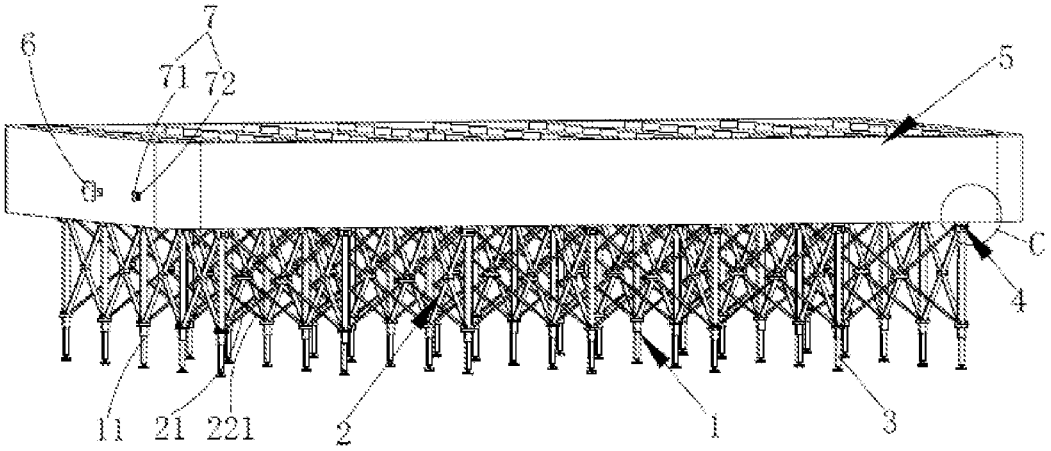
FIG. 6 is a schematic view showing the overall structure of the foldable bed frame and the inflatable bed according to the embodiment of the present application.
Figure 7:
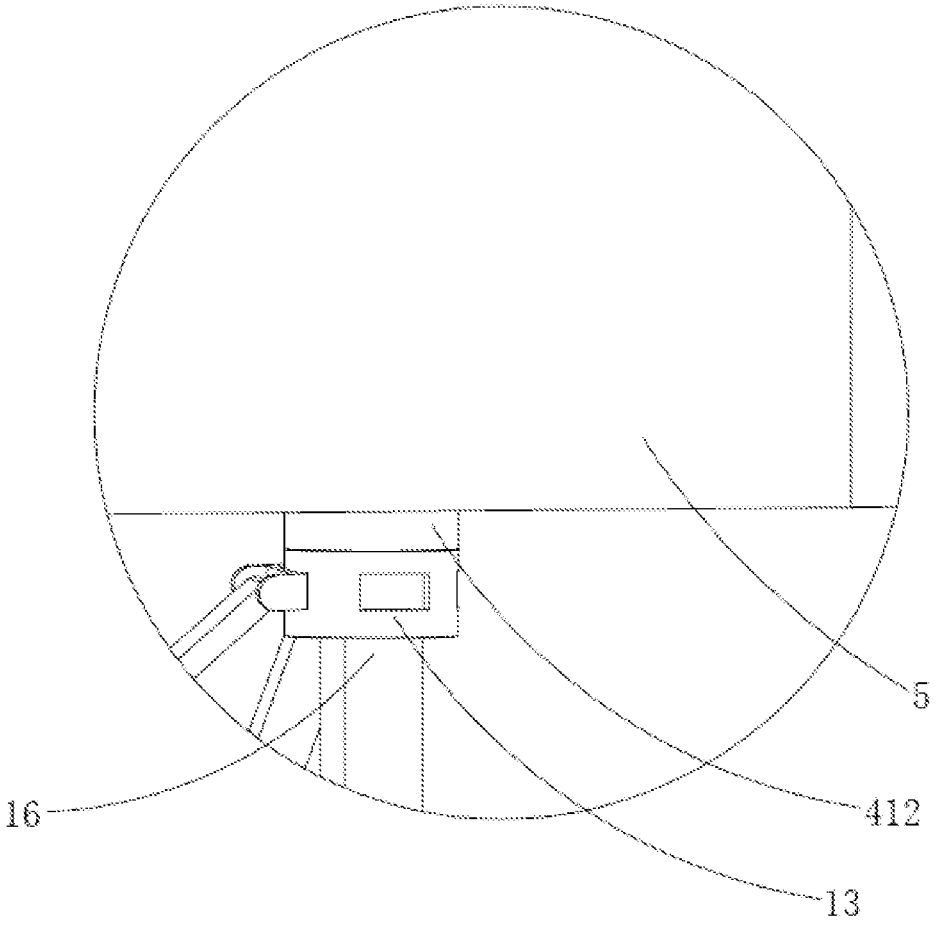
FIG. 7 is an enlarged view of portion C in FIG. 6 according to the embodiment of the present application.

Referring to FIGS. 6-7, the inflatable bed includes a bed body 5, an inflatable pump 6, a connection assembly 4 and a foldable bed frame. The inflatable pump 6 is mounted in the bed body 5, the connection assembly 4 is configured for connecting the bed body 5 with the foldable bed frame. In addition, the inflatable bed further includes a pressure adjustment assembly 7, which includes a gas-pressure meter 71 and an air pressure regulator 72. The gas-pressure meter 71 and the air pressure regulator 72 are mounted on the sidewall of the bed body 5. The air pressure in the bed body 5 can be monitored in real time by the gas-pressure meter 71, which also can be quickly adjusted through the air pressure regulator 72 by users, such that the air pressure in the bed body 5 is suitable for sleeping.

Referring to FIGS. 3 and 7, the connection assembly 4 includes a plurality of buckles 41, and the buckle 41 includes a buckle head 411 and a connection portion 412 which are integrally formed. The connection portion 412 is disc-shaped, the buckle head 411 is pin-shaped, whose axial direction extends perpendicular to the connection portion 412. One side of the connection portion 412 is welded with the bottom wall of the bed body 5, and the other side thereof is welded with the buckle head 411. A buckle hole 133 for fitting with the buckle head 411 is formed on the top wall of the connection sleeve 13. After the buckle head 411 is inserted into the buckle hole 133, it is engaged with the connection sleeve 13 to fix the bed body 5 with the foldable bed frame.

The implementation principle of the foldable bed frame and inflatable bed for this embodiment of the present application is as follows. Firstly, the inflatable bed is mounted on the foldable bed frame by the connection assembly 4, then the bed body 5 is inflated by the inflatable pump 6, such that the bed body 5 gradually expands and spreads, and in turn the connection assembly 4 drives the array of the support assemblies 1 to unfold themselves, and the support assembly 1 drives the foldable assembly 2 to unfold itself along the expansion direction to stably support the inflatable bed.

REFERENCE SIGN LIST

1 support assembly
11 support pillar
111 stationary section
112 slidable section
1121 first mounting groove
113 adjustment component
1131 first spring
1132 limit rod
114 first opening
12 slidable component
121 slidable sleeve
122 hinge flap
13 connection sleeve
131 second mounting groove
132 insertion hole
133 buckle hole
14 mounting block
141 third mounting groove
15 mounting component
151 second spring
152 lock rod
16 connection end
17 support end
2 foldable assembly
21 connection rod
211 connection section
22 hinge joint
221 upper hinge portion
222 lower hinge portion
2221 lock hole
2222 second opening
223 fastener
2231 lock lever
2232 snap-in block
2233 third spring
224 recess
3 height adjustment assembly
31 stud
32 support base
33 base sleeve
4 connection assembly
41 buckle
411 buckle head
412 connection portion
5 bed body
6 inflatable pump
7 pressure adjustment assembly
71 gas-pressure meter
72 air pressure regulator

What is claimed is:

1. A foldable bed frame, comprising a plurality of support assemblies and a plurality of foldable assemblies, the plurality of support assemblies are distributed in an array, and each of the plurality of foldable assemblies is provided between two adjacent ones of the plurality of support assemblies, respectively, wherein each of the plurality of support assemblies comprises a support pillar and a slidable component, a first end of the support pillar is configured as a connection end, a second end of the support pillar is configured as a support end, and the slidable component is slidably connected to the support pillar and slides along a length direction of the support pillar towards or departing from the connection end, wherein each of the plurality of foldable assemblies comprises two connection rods intersecting with each other, the two connection rods of a same one of the plurality of foldable assemblies are located between two adjacent ones of the plurality of support pillars, a first end of each of the two connection rods is hinged with the connection end of one of the two adjacent ones of the plurality of support pillars, and a second end of each of the two connection rods is hinged with the slidable component of a second one of the two adjacent ones of the plurality of support pillars, and wherein each of the plurality of support assemblies further comprises a mounting block and a connection sleeve, the connection sleeve is sleeved on the connection end of the support pillar, a first mounting groove configured to receive the mounting block is defined on the connection sleeve, the first mounting groove extends along a radial direction of the support pillar, and a side of the mounting block departing from the support pillar is configured to be hinged with a respective one of the two connection rods.

2. The foldable bed frame according to claim 1, further comprising a height adjustment assembly, wherein the height adjustment assembly comprises a bolt, an axial direction of the bolt extends parallel to the support pillar, and the bolt is in threaded connection with the support end of the support pillar directly or indirectly.

3. The foldable bed frame according to claim 2, wherein the height adjustment assembly further comprises a support base, the support base is connected to an end of the bolt departing from the support pillar, and a cross-section area of the bolt is less than a cross-section area of an end surface of the support base departing from the support pillar.

4. The foldable bed frame according to claim 3, wherein the height adjustment assembly further comprises a base sleeve screwed to the bolt, and an end of the base sleeve departing from the support base is fastened on the support pillar.

5. The foldable bed frame according to claim 1, wherein the slidable component comprises a slidable sleeve and at least two hinge flaps, the slidable sleeve is slidably connected to the support pillar and slides along the length direction of the support pillar, the at least two hinge flaps are fixedly connected to a peripheral wall of the slidable sleeve, and each of the at least two hinge flaps is configured to be hinged with a respective one of the two connection rods.

6. The foldable bed frame according to claim 1, wherein the support pillar comprises a stationary section, a slidable section and at least one adjustment component, the support end is located on the stationary section, the connection end is located on the slidable section, the slidable section is coaxially sleeved on the stationary section, the slidable section is slidable along a length direction of the stationary section, the slidable component is slidably connected to the slidable section, and the at least one adjustment component is configured to position the slidable section relative to the stationary section.

7. The foldable bed frame according to claim 6, wherein each of the at least one adjustment component comprises a spring and a limit rod, a second mounting groove, in which the limit rod is slidable, is defined on a sidewall of the stationary section, the spring is located in the second mounting groove, a first end of the spring abuts against the stationary section, a second end of the spring abuts against the limit rod, and an opening configured to receive the limit rod is defined on an inner wall of the slidable section.

8. The foldable bed frame according to claim 7, wherein an end of the limit rod facing the opening is hemispherical.

9. The foldable bed frame according to claim 1, wherein each of the plurality of support assemblies further comprises two sets of mounting components, the two sets of mounting components are symmetrically arranged at opposite sides of the mounting block, each mounting component of the two sets of mounting components comprises a first spring and a lock rod, a second mounting groove, in which the lock rod is slidable, is defined at a side of the mounting block facing the connection sleeve, the first spring is mounted in the second mounting groove, a first end of the first spring abuts against the mounting block, a second end of the first spring abuts against the lock rod, and an insertion hole configured to receive the lock rod is defined on the connection sleeve.

10. The foldable bed frame according to claim 9, wherein an end of the lock rod facing the insertion hole is hemispherical.

11. The foldable bed frame according to claim 9, wherein each of the plurality of foldable assemblies further comprises a hinge joint, the hinge joint comprises an upper hinge portion, a lower hinge portion and a fastener, the upper hinge portion is above the lower hinge portion, and the upper hinge portion is fixedly connected to the lower hinge portion by the fastener, and each of the two connection rods comprises two connection sections, defined as a first connection section and a second connection section, wherein the first connection section is hinged with the upper hinge portion, the second connection section is hinged with the lower hinge portion, the first connection section is hinged with the mounting block at an end departing from the upper hinge portion, and the second connection section is hinged with the slidable component at an end departing from the lower hinge portion.

12. The foldable bed frame according to claim 11, wherein the fastener comprises a lock lever, a snap-in block and a second spring connected to the snap-in block, the lock lever is fixedly connected to a bottom wall of the upper hinge portion, and a lock hole configured to be inserted in by the lock lever is defined on the lower hinge portion, an opening, in which the snap-in block is slidable, is defined on a hole wall of the lock hole, the opening is in communication with the lock hole, the second spring is located in the opening, a first end of the second spring abuts against the snap-in block, and a second end of the second spring abuts against a bottom wall of the opening, and a recess configured for snapping the snap-in block is defined on a sidewall of the lock lever.

13. An inflatable bed, comprising a bed body, an inflatable pump, a connection assembly and the foldable bed frame according to claim 1, wherein the inflatable pump is configured for supplying air to an interior of the bed body, and the bed body is provided on the foldable bed frame, and the bed body is connected to the foldable bed frame by the connection assembly.

14. The inflatable bed according to claim 13, wherein the connection assembly comprises a plurality of buckles, each of the plurality of buckles comprises a buckle head and a connection portion which are integrally formed, the connection portion is fixedly connected to a bottom wall of the bed body, and a buckle hole configured for fitting with the buckle head is defined on a top wall of the connection sleeve of each of the plurality of support assemblies.

* * * * *